United States Patent [19]

Mitchell

[11] 4,417,433

[45] Nov. 29, 1983

[54] METHOD OF MAKING INFUSION PACKAGE

[75] Inventor: Robert M. Mitchell, Norwalk, Conn.

[73] Assignee: Thomas J. Lipton, Inc., Englewood Cliffs, N.J.

[21] Appl. No.: 258,527

[22] Filed: Apr. 28, 1981

Related U.S. Application Data

[62] Division of Ser. No. 74,260, Sep. 10, 1979, Pat. No. 4,290,521.

[51] Int. Cl.[3] ..... B65B 29/04

[52] U.S. Cl. ..... 53/413; 206/0.5; 53/134; 53/451

[58] Field of Search ..... 53/451, 551, 552, 134, 53/413; 206/0.5; 426/83, 82, 81, 77

[56] References Cited

U.S. PATENT DOCUMENTS

| | | | |
|---|---|---|---|
| 1,581,578 | 4/1926 | Kieselbach | 426/77 |
| 2,186,087 | 1/1940 | Yates . | |
| 2,328,017 | 8/1943 | Irmscher | 206/0.5 |
| 2,359,292 | 10/1944 | Barnett . | |
| 2,571,138 | 10/1951 | Irmscher . | |
| 2,791,505 | 5/1957 | Barnett . | |
| 3,115,967 | 12/1963 | Branstner | 426/83 |
| 3,346,388 | 10/1967 | Andrews et al. | 206/0.5 X |
| 3,355,854 | 12/1967 | Lowry | 53/451 |
| 3,529,397 | 9/1970 | Leasure | 53/451 |
| 3,539,355 | 11/1970 | Kasakoff . | |
| 3,542,561 | 11/1970 | Rambold . | |
| 3,577,301 | 5/1971 | Gustafson | 156/461 |
| 3,597,222 | 8/1971 | Kalemba . | |
| 4,055,668 | 10/1977 | Kopp | 206/0.5 X |
| 4,064,662 | 12/1977 | O'Toole | 229/22 |

FOREIGN PATENT DOCUMENTS

| | | | |
|---|---|---|---|
| 803124 | 6/1936 | France . | |
| 631381 | 12/1961 | Italy | 229/22 |
| 184625 | 8/1936 | Switzerland . | |
| 446791 | 6/1936 | United Kingdom . | |
| 502266 | 3/1939 | United Kingdom | 229/22 |

*Primary Examiner*—James F. Coan

*Attorney, Agent, or Firm*—Brumbaugh, Graves, Donohue & Raymond

[57] ABSTRACT

An infusion package that has a natural, expanded, unflattened or three-dimensional condition is folded to a flattened configuration to pack in quantity. The expanded condition gives greater internal volume by which infusion is improved and quickened. A pull string, affixed near the flattening folds, unfolds the package from its flattened configuration. To make the package, a tube can be formed into a generally tetrahedral shape by forming seams across it, each at 90° to the preceding seam, severing the package so formed, and folding inward across one end seam to the tetrahedron to effect the flattening.

6 Claims, 4 Drawing Figures

METHOD OF MAKING INFUSION PACKAGE

This is a division of application Ser. No. 074,260, filed Sept. 10, 1979, now U.S. Pat. No. 4,290,521.

BACKGROUND OF THE INVENTION

This invention relates to infusion packages and the method by which they are made. More particularly, the invention relates to improved infusion packages that have a flattened configuration for packing and a stable, unflattened or three-dimensional, expanded configuration that provides a large volume interior for better, more effective contact between liquid and fill.

Increased surface area contact between a liquid and infusible solids speeds infusion. Movement of the liquid over and about the surfaces of the solids results in faster infusion. Prior art infusion packages have not had interiors with enlargeable volumes adequate to loosely contain the infusible fill and to thereby give improved surface area contact and better passage of liquid into and out of the mass of wet fill.

The most familiar infusion package is the ordinary tea bag. The single compartment or "pillow" tea bag is a flat bag of liquid pervious material that contains enough tea for a single serving. Of itself, the bag has no internal volume. Only the presence of fill, that is to say the tea, spreads the envelope's sides to give the bag volume to accommodate the contents. As is well known in the art, tea swells when wet. It forms a swollen compacted mass that may fill or nearly fill the conventional single envelope bag. Even if abundant space is left in the bag, the natural flat disposition of the envelope tends to keep the tea compacted. The swelling tea presses outwardly against the inside walls of the envelope which are constrained by linear upper and lower seams and linear side edges. Penetration by the liquid into and through the mass of tea is limited. Infusion or steeping occurs primarily through the envelope sides where they separate the surface of the swollen tea mass from the water. Stirring the tea or dunking the bag speeds infusion by interrupting the tendency of the liquid inside and outside the bag to reach equilibrium near the bag sides.

Some prior art suggests pleats or the like to accommodate the swelling of the tea when the bag is immersed. The pleats in the bag accommodate the swelling of the tea. Often these bags have only a naturally flat disposition against which the swelling tea must act to cause expansion of the bag. The volume to which the bag expands is only that demanded by the swelling of the tea. No excessive volume that would permit looseness of the tea mass and easy flowing of water about the leaf particles would seem to result.

Prior art infusion packages with two or more fill containing segments did increase the surface area of infusible fill exposed to liquid through the side of the package. The art is replete with tea bags divided into several tea-containing sections. Providing connected segments that permitted liquid flow between the segments exposed more bag surface area to liquid for extraction therethrough. It is true that these bags improved brewing, but in each segment, the mass of tea compacts as it swells against the sides of each individual segment, and even though there is more surface tea, there is little opportunity for liquid to flow in and about tea particles in the center of the mass.

SUMMARY OF THE INVENTION

In accordance with this invention an infusion package has a stable three-dimensional expanded configuration and a flattened configuration suitable for packing. The method of making the package includes steps suitable for repeated and rapid preparation of packages capable of being packed efficiently and with little or no volume increase in the shipping or retail carton.

Specifically, a tea bag is provided herein that has a generally tetrahedral shape whereby its internal volume is greater than that of prior bags of like height and width and whereby the tea leaf particles are less constrained during brewing. More internal volume is provided than conventional pillow bags that use similar amounts of bag material and more internal volume is provided than in commercial two-pouch bags that use much more material. Although ordinarily such a shape would be impermissable for packing purposes, folds in the tea bag permit its collapse to a flattened configuration that can be packed in quantity. The bags familiar string or plastic strip is affixed at or near a fold so that, by pulling on the string or strip, the bag can be expanded to its stable, three-dimensional configuration. Moreover, air initially filling the remainder of the volume of the expanded bag prevents the bag's collapse when immersed. Water then displaces the air within the expanded bag.

Tea that is brewed by being placed loose in a cup or pot of boiling water is constrained only by the boundaries of the cup or pot and is freely moved about by the water so that essentially the entire surface area of all the tea leaf particles contribute to the brewing. Any movement in the water enhances brewing by bringing fresh liquid near the tea leaf surfaces. For a tea bag to approximate this condition, it should have a stable three-dimensional shape that does not constrain the tea. However, packing such relatively bulky tea bags in any quantity would require a very large volume increase for any number of packed bags. A particularly attractive feature of this invention is its ability to be packed in little or no more space than the ordinary tea bag currently on the market and yet to provide relatively large increases in useful internal volume for brewing.

Bags formed in accordance with the invention can increase the rate of extraction by which steeping or infusion occurs. The bags contribute one or more of (a) faster, more effective steeping, (b) less tea per bag, and (c) greater choice of tea mixtures to give good brewing from mixes that previously would not have been satisfactory. Approximately forty percent less of the liquid permeable bag material is needed than with a commercial two-pouch bag having the same height and width. The bag gives better filter flow characteristics with better movement of extracted solids from within the bag to the liquid outside.

BRIEF DESCRIPTION OF THE DRAWINGS

The above and further features of the invention will be better understood with reference to the following detailed description of a preferred embodiment and to the attached drawings wherein.

DESCRIPTION OF PREFERRED EMBODIMENT

Figure 1:
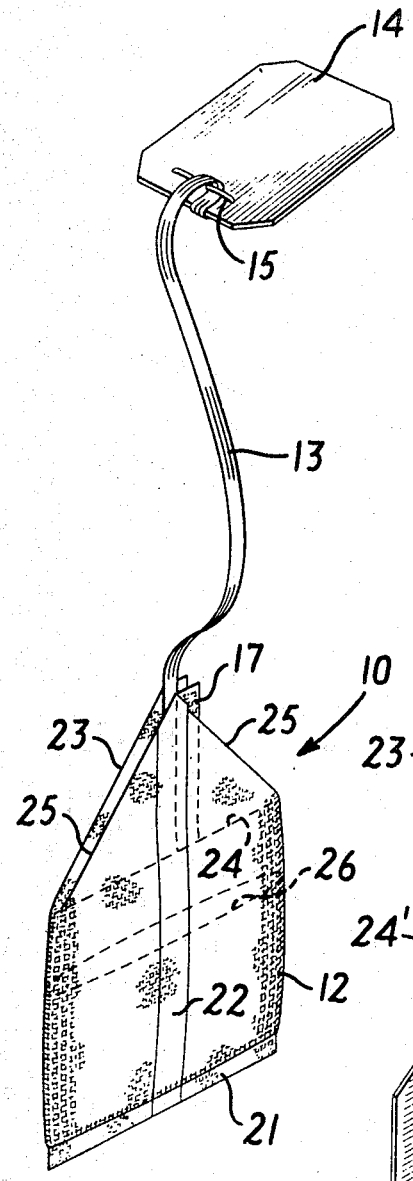
FIG. 1 is a perspective view of a tea bag in collapsed ready-to-pack condition.

In FIG. 1 a tea bag combination 10 includes a bag 12, a plastic strip 13, and a tab 14. A staple 15 affixes the strip to the tab. The strip 13 can be adhesively secured to an upper seam area 17 better illustrated in FIG. 3, or can be tacked by heat-fusing or stapling. Likewise, an ordinary string can replace the strip 13 and may be stapled, if desired, to the seam area 17 of the bag. As used herein the term "pull means" includes a string, the long thin plastic strip 13, or any other long pull member suitable for dunking a tea bag in or retrieving the bag from a prepared cup of tea.

Figure 2:
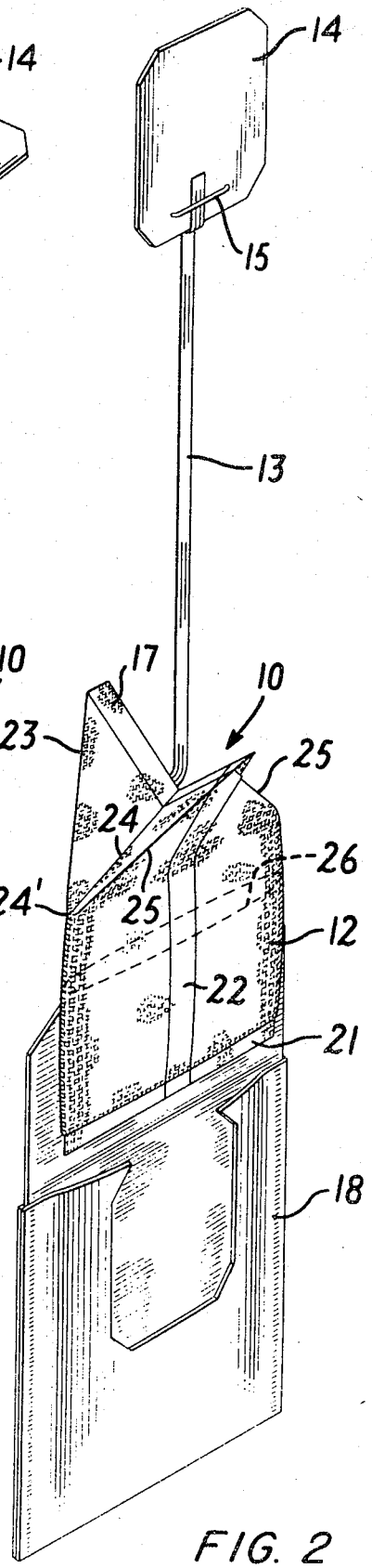
FIG. 2 is a perspective view of the tea bag of FIG. 1 during its withdrawal from an associated individual envelope.

FIG. 2 illustrates a packet or wrapper 18 for the tea bag 10. As is known in the art, the tab 14 can be a tear away part of the packet sidewall, perforated for easy removal.

Figure 3:
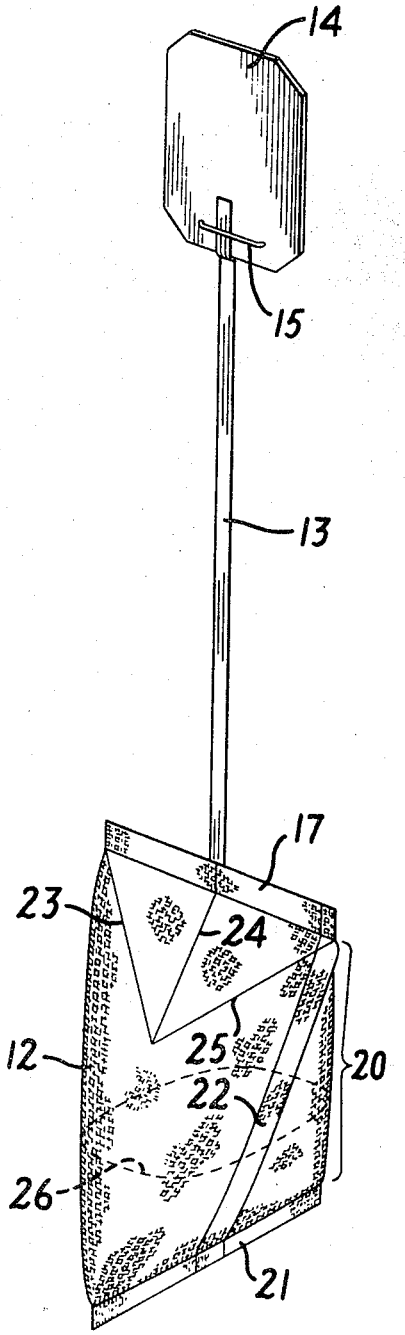
FIG. 3 is a further perspective view of the tea bag of FIGS. 1 and 2 and illustrates the stable, expanded configuration of the bag as it is used in brewing tea.

FIG. 3 illustrates the generally tetrahedral shape of the bag 12. This is the bag's intended configuration for brewing tea. Other tetrahedral packages are known for packaging individual drinks of milk or juice, for example. The bag 12 has a tubular body portion closed at its upper end by the seam area 17 extending entirely across the top and closed at its bottom end by another seam area 21 extending entirely across its bottom. The top and bottom seam areas are not parallel. Rather, viewed from the top or bottom one crosses over the other. In particular, in the embodiment illustrated, the directions in which the seam areas extend appear generally perpendicular, again when viewed from the top or the bottom. And in the case of this particular bag the seams are also both perpendicular to the axis or lengthwise direction of the body. A side seam 22 by which the tubular body 20 was formed is clearly visible in each of FIGS. 1, 2 and 3. The material from which the bag 12 is formed is a liquid permeable paper or other material known in the art. The term "generally tetrahedral" means that although the tubular body can be exactly a tetrahedron if desired, the bag body is not necessarily sharply folded to form four distinctly defined flat sides, but may be left partly rounded between the top and bottom seams, as shown.

Lines of fold 23, 24 and 25 enable the bag 12 to collapse to its flattened configuration shown in FIG. 1. The line of fold 24 crosses the seam 17 at or near its center and is generally parallel the lower seam 21. On each side of the seam 17 the lines of fold 23 and 25 begin at the ends of the seam 17 and converge upon the fold 24 at a point 24'. These folds permit the tea bag to be packed in the packet 18 and in a small carton with numerous other tea bags.

The strip 13 is affixed to the upper seam area 17 near the center fold 24 so that, as the bag 12 is pulled from the packet 18, it begins to open and air enters the bag. This helps prevent collapse when the bag is immersed.

For best use, one should pull the upper seam area 17 to its straight or nearly straight position. The bag approaches the tetrahedral shape and remains in its stable, expanded, three-dimensional condition. A line 26 in FIG. 3 shows the dry tea level in the bag 12 with the bag in an upright position. A large percentage of the internal volume of the bag 12 is free, not only to accommodate swelling of the tea, but to permit greater looseness, better liquid-tea contact, better tea and liquid movement, and improved steeping. The tea can occupy less than half the volume of the expanded bag and without increasing the overall height and width beyond those of an ordinary tea bag. In an actual embodiment the bag height measured approximately $2\frac{1}{4}''$ (57.2 mm.) and the width approximately $1\frac{1}{2}''$ (38.1 mm.) These are substantially the same height and width as at least one tea bag that is currently widely sold in individual envelope packaging.

Figure 4:
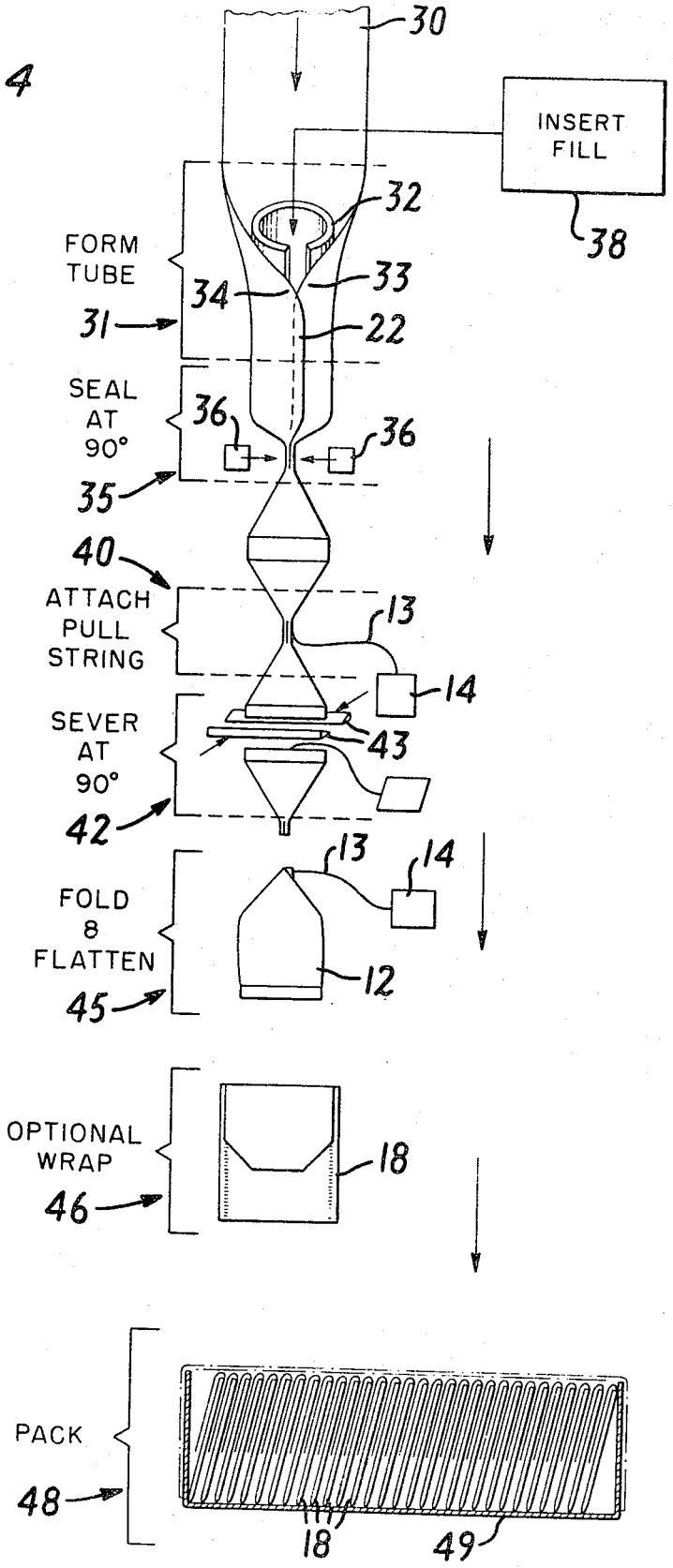
FIG. 4 is a diagramatic illustration of the steps of forming, filling, and packing tea bags according to the invention.

As for the method of making infusion packages of the kind illustrated in FIGS. 1 through 3, the diagram of FIG. 4 sets out the steps which can be performed automatically and continually, or partly or wholly manually, to form the improved tea bags from a continuous strip 30 of liquid permeable material. The continuous strip or web 30 is first formed into a tube at a station 31. This can be done by continuously wrapping a web of the permeable material about a shoe 32 and crimping or sealing lateral edges 33 and 34 to form the side seam 22 that appears in FIGS. 1 through 3.

Downstream the tube is sealed at a sealing station 35, for example by sealing bars 36. The bars may crimp the tube across its width or apply heat to either activate adhesive at the top and bottom seams or to use the permeable material of the bag into a seam if the material is thermoplastic for example. Alternate seams are formed at 90° with respect to each other by moving the bars 36 through 90° or by providing, for alternate activation, a second set of bars (not shown) perpendicular to the bars 36.

After each seal has been made a suitable dispensing mechanism 38 adds fill, such as a single serving of tea. The strip 13 can be attached at any one of a number of places in the bag forming process, but in FIG. 4, a station 40 is shown wherein the plastic strip is tacked to the upper seam area 17 by stapling or heating to form the pull means.

The next station 42 severs the web into individual packages. A pair of blades 43 is diagramatically shown for this purpose. Again they may alternately be moved 90° to sever each seam into an upper and lower seam area of the bags being separated, or a second pair of blades (not shown) may be provided at 90° to the blades 43 and alternately activated.

Next, at a station 45 the fold lines 23, 24, and 25 of FIGS. 1 through 3 are formed. The center fold 24 is formed inward across the upper seam area 17 and parallel the lower seam area 21. Again, this can be done manually or automatically by engaging the upper seam area, centrally pushing it inward, and then flattening the bag. The bag is thus folded and flattened for packing.

At an optional station 46, the outer packet or envelope 18 is wrapped about the bag. If the tab 14 is part of the packet 18, attachment of the tab to the strip 13 can occur here.

At a last station 48, the bags are boxed for shipping and sale. The box 49 is shown housing a quantity of the packets 18, each containing a folded and flattened infusion package. Far more bags are packed than would have been possible had the tetrahedral shape been maintained.

It will be appreciated that infusion packages of the kind described herein can be useful other than as tea bags. In summary, their use can lessen brewing time, permit use of less fill per package, or of a different fill or a combination of these improvements without lessening the quality of the product prepared. The increased volume that the package contributes is achieved with little or no loss of packing space.

Although the foregoing description and the associated drawings set forth preferred embodiments of the package and its method of formation, it will be recognized that modifications may be made without departure from the spirit and scope of the invention as defined in the appended claims.

I claim:

1. A method of making an infusion package including:

(a) forming a generally tetrahedral package of liquid permeable material, (b) introducing a quantity of fill, (c) folding the package inwardly to flatten the package after introducing the fill; and (d) affixing a pull means to the package at a location moved inward by the fold so as to provide unfolding of the fold outward by pulling the pull means.

2. The method according to claim 1 wherein the step of forming a generally tetrahedral package includes forming top and bottom angularly related seams in a tubular package body, and said step of folding includes forming an inward fold across one of said seams.

3. The method according to claim 2 wherein said step of forming an inward fold across one of said seams includes folding the one seam inwardly along an intersecting fold crossing the one seam in substantially the same direction as the other seam.

4. The method according to claim 11 wherein the step of attaching pull means comprises attaching the pull means to the package at or near the intersection of the fold and the one seam so that the fold can be unfolded to straighten the one seam and expand the package to its generally tetrahedral shape.

5. A method of forming an infusion package including (a) forming a package of liquid previous material having a stable, expanded, three-dimensional shape, (b) filling and sealing the package, (c) folding the package to a flattened shape, and (d) attaching a pull means to the package where it is folded to expand the package when pulled.

6. The method according to claim 5 wherein the step of filling includes adding an infusible substance to fill less than half of the volume of the expanded package.

* * * * *

UNITED STATES PATENT AND TRADEMARK OFFICE

CERTIFICATE OF CORRECTION

PATENT NO. : 4,417,433

DATED : November 29, 1983

INVENTOR(S) : Robert M. Mitchell

It is certified that error appears in the above-identified patent and that said Letters Patent is hereby corrected as shown below:

In column 2, line 31, after "boiling" insert --or near boiling--.

In column 6, line 8, "claim 11" should read --claim 3--.

Signed and Sealed this

*Fifth* Day of *June 1984*

[SEAL]

*Attest:*

GERALD J. MOSSINGHOFF

*Attesting Officer*

*Commissioner of Patents and Trademarks*